United States Patent [19]

Trageser

[11] 4,010,685

[45] Mar. 8, 1977

[54] PRINTING PLATE CLAMPING DEVICE

[75] Inventor: Karl Trageser, Rodenbach II Krs. Hanau, Germany

[73] Assignee: Roland Offsetmaschinenfabrik Faber & Schleicher AG, Germany

[22] Filed: June 27, 1975

[21] Appl. No.: 591,029

[30] Foreign Application Priority Data

June 28, 1974 Germany ..... 2431133

[52] U.S. Cl. ..... 101/415.1; 101/378

[51] Int. Cl.[2] ..... B41F 27/06; B41F 7/22

[58] Field of Search ..... 101/378, 415.1, DIG. 12

[56] References Cited

UNITED STATES PATENTS

| | | | |
|---|---|---|---|
| 1,927,728 | 9/1933 | Wolff | 101/415.1 X |
| 2,271,160 | 1/1942 | Huck | 101/415.1 |
| 3,119,331 | 1/1964 | Koch et al. | 101/415.1 |
| 3,151,553 | 10/1964 | Norton | 101/415.1 |
| 3,154,012 | 10/1964 | Fischer | 101/415.1 |
| 3,424,085 | 1/1969 | Beisel | 101/415.1 |
| 3,536,003 | 10/1970 | Oderman | 101/415.1 |
| 3,557,695 | 1/1971 | Preuss | 101/415.1 |
| 3,658,002 | 4/1972 | Preuss | 101/415.1 |
| 3,675,573 | 7/1972 | Hawks | 101/415.1 |
| 3,791,295 | 2/1974 | Albright | 101/415.1 |
| 3,835,778 | 9/1974 | Bock | 101/415.1 |
| 3,844,214 | 10/1974 | Smith | 101/415.1 |
| 3,858,511 | 1/1975 | Moyer | 101/415.1 |
| 3,858,512 | 1/1975 | Simeth | 101/415.1 |
| 3,884,147 | 5/1975 | Abendroth | 101/415.1 |

*Primary Examiner*—Edgar S. Burr
*Assistant Examiner*—Paul J. Hirsch
*Attorney, Agent, or Firm*—Leydig, Voit, Osann, Mayer & Holt, Ltd.

[57] ABSTRACT

A clamping and tensioning mechanism for mounting a thin flexible printing plate on the surface of a printing cylinder in which a mounting bar is provided having a longitudinal groove formed therein occupied by a clamping bar having upper and lower jaws which are shaped to deform and positively grip the end of the plate. The groove is of dovetail cross section so as to present opposed wedging surfaces having a shallow wedge angle, a spring being interposed in the root of the groove. As a result, when the end of the plate is inserted between the jaws and the mounting bar is subsequently moved in the plate tensioning direction, the jaws of the clamping bar are wedged together to deform the end of the plate and, upon continued movement of the mounting bar, the end of the plate is bodily drawn to tension the plate about the cylinder, thereby to provide positive lock-up. At the end of a printing run, when it is desired to remove the plate, a demounting tool applies inward retracting pressure to the upper jaw for disengagement of the clamping bar from the wedging surfaces to permit spreading of the jaws for release of the end of the plate. In one embodiment of the invention the mounting bar is in two sections spaced end to end and separately adjustable in the peripheral direction with expansible means for bridging the gap between them.

6 Claims, 10 Drawing Figures

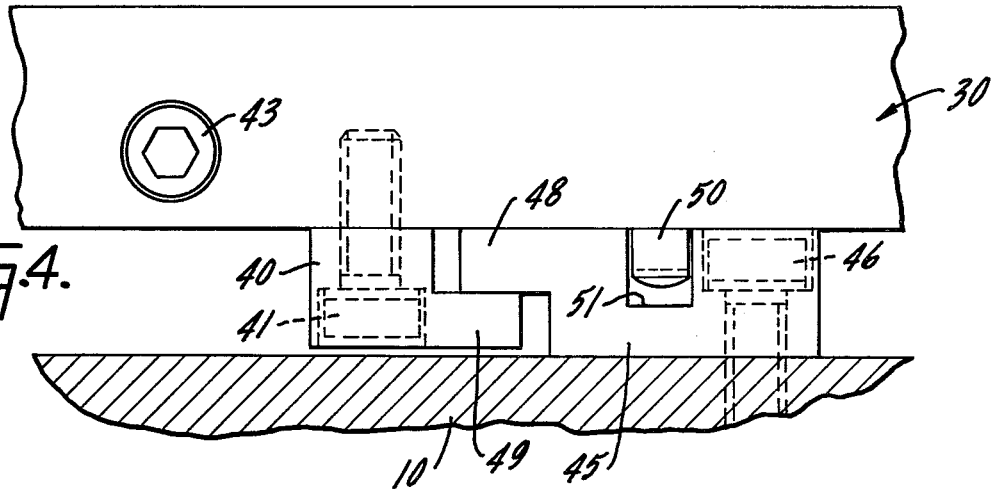
fig.4.
fig.5.
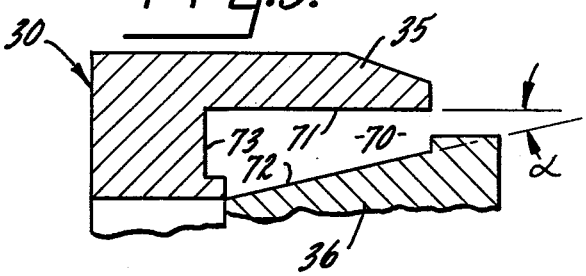
fig.6.
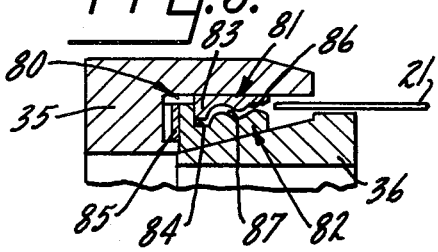
fig.7.
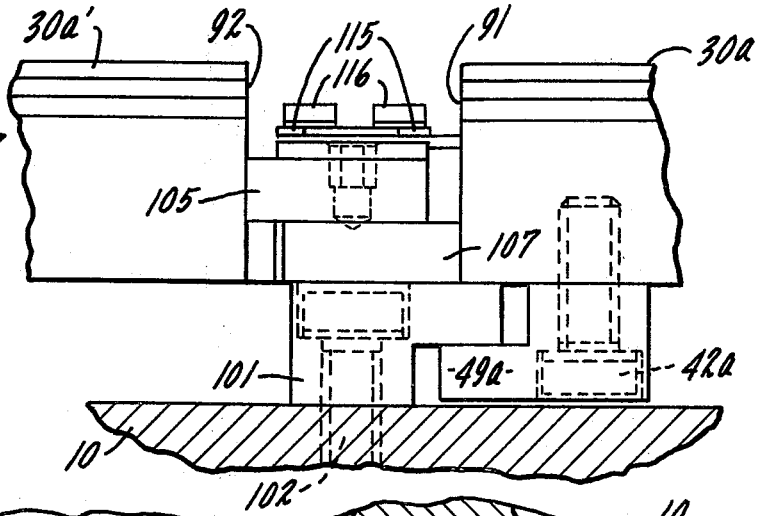
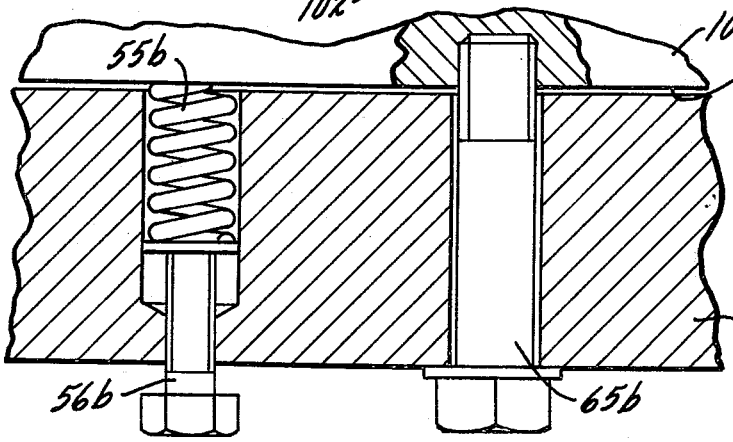
fig.8.

PRINTING PLATE CLAMPING DEVICE

A large proportion of all printing is done using thin flexible printing plates resulting in a continuous search for satisfactory mechanisms for clamping and tensioning the ends of the plate. The need has been recognized for a mechanism in which an increase in tensioning force automatically brings about an increase in the clamping force. For example in German Pat. No. 1,178,443 the end of the plate is clamped in a wedge-shaped clamping piece which is mounted in a mounting bar having a longitudinal slot of wedge-shaped cross section. For the actuation and especially for the loosening of the clamping piece a pneumatic actuator is provided, with operation of the actuator serving to clamp the end of the plate between the clamping piece and the mounting bar. Such an arrangement has the disadvantage that either a very great clamping force must be exerted or that the surfaces on the clamping piece and mounting bar which hold the end of the plate must, as proposed in the patent, be roughened. However, if the surfaces are roughened, difficulty is encountered in releasing the clamping piece and excessively high releasing forces must be applied.

It is an object of the present invention to provide a clamping and tensioning mechanism for a thin flexible printing plate which is absolutely reliable and self-locking, which may be easily and quickly operated and which may be easily loosened using only light manual forces for replacement of the plate at the end of a printing run.

It is a more specific object of the present invention to provide a mounting bar having a groove of dovetail shape having mounted within it a clamping bar formed of a pair of cooperating jaws which are specially shaped to deform the end of the plate, with the dovetail being sufficiently shallow and the gripping surfaces having sufficient initial purchase so that the end of the plate is sequentially deformed and then drawn tight upon continuous movement of the mounting bar. It is a related object of the present invention to provide novel means for biasing the clamping bar outwardly while permitting it to yield for spreading of the jaws incident to insertion of a plate but with the restoring force being sufficiently great and the wedge angle sufficiently small so as to create initial purchase with the result that application of tension causes the end of the plate to be self-deformed and hence self-locking by wedging action.

It is another detailed object of the invention to provide a novel demounting tool for engaging and retracting the upper clamping jaw thereby to move the clamping bar inwardly of the groove for disengagement of the wedging surfaces and to permit spreading of the jaws for release of the end of the plate.

It is yet another object of the present invention to provide a mounting bar of the above type which is formed in two sections spaced end to end, sections which are capable of acting together to accommodate a wide plate but which are also capable of separate adjustment for accommodation of two narrower plates arranged side by side and with novel means for taking up the space which separates the opposed ends of the sections.

It is an object of the present invention to provide a clamping and tensioning mechanism for a thin flexible printing plate which is extremely simple to use requiring only the insertion of the end of the plate between opposed jaws in a mounting bar, with subsequent shifting of the mounting bar serving to clamp the end of the plate followed by tensioning of the plate about the cylinder.

It is a related object to provide a clamping and tensioning mechanism for a thin flexible printing plate in which springs and jack jack screws are employed for positive positioning but in which the functions of the springs and jack screws may be readily inverted, with minimum change in the construction, to provide continuous resilient take-up.

It is a general object of the invention to provide a clamping and tensioning mechanism for a flexible printing plate which is inherently economical to construct and maintain.

Other objects and advantages of the invention will become apparent upon reading the attached detailed description in connection with the drawings in which:

FIG. 4 is a fragmentary elevational view looking along the line 4—4 in FIG. 1.

FIG. 5 is an enlarged fragment showing the dovetail groove.

FIG. 6 shows retraction and separation of the clamping jaws incident to insertion of the end of a plate.

FIG. 7 is a fragmentary elevational view looking along the line 7—7 in FIG. 1.

FIG. 8 illustrates reversal of the spring and jack screw functions.

Figure 1:
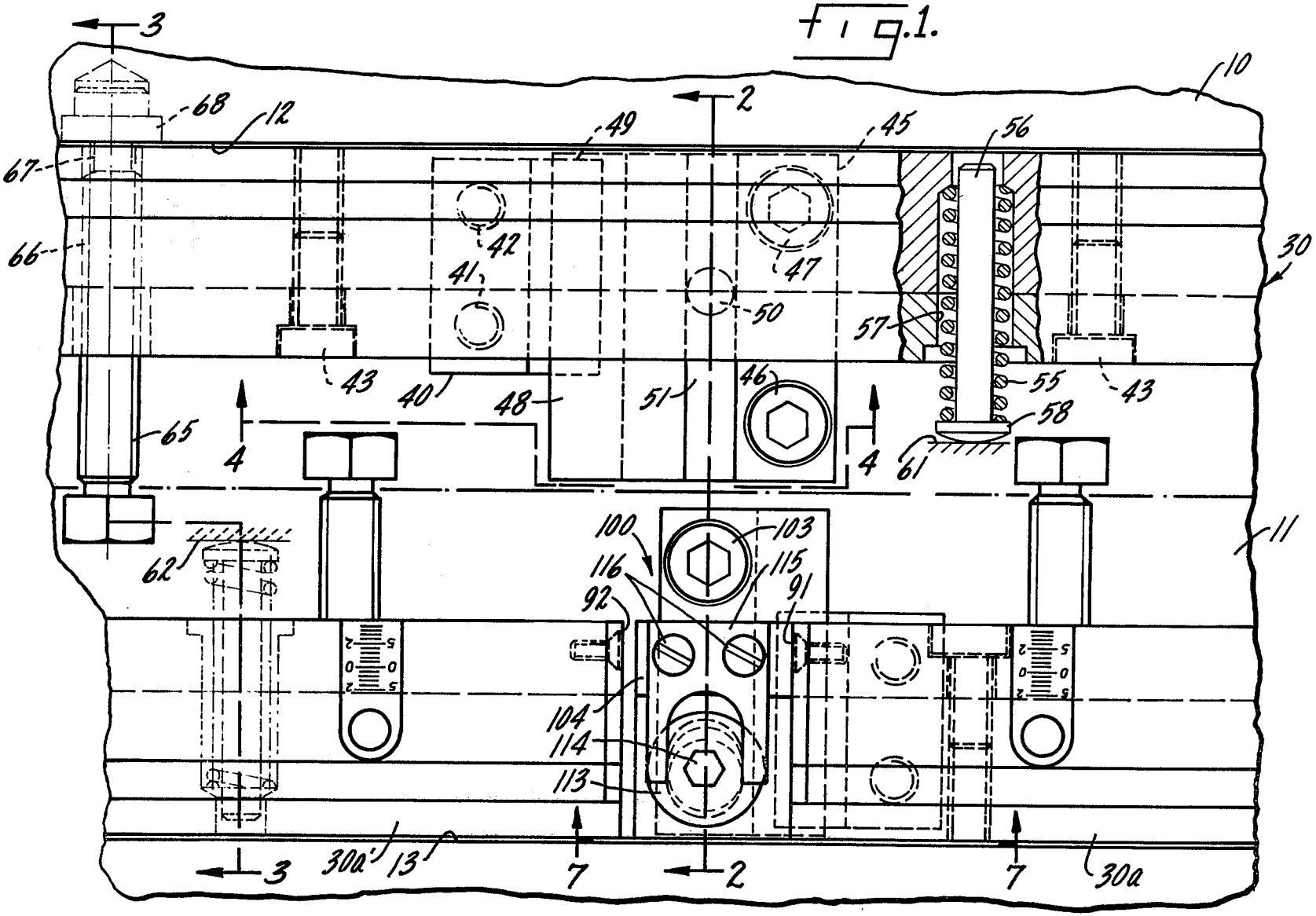
FIG. 1 is a fragmentary plan view showing a clamping and tensioning mechanism constructed in accordance with the invention.

While the invention has been described in connection with a preferred embodiment, it will be understood that I do not intend to limit the invention to the embodiments shown but intend, on the contrary, to cover the various alternative and equivalent constructions included within the spirit and scope of the appended claims.

Turning now to the drawings there is shown a section of printing cylinder 10 having a longitudinally extending groove or gap 11 having side walls 12, 13 and a bottom wall or root surface 14. Stretched about the periphery of the printing cylinder is a thin flexible printing plate 20 having a first end 21 and a second end 22. Recessed in the gap, and for the purpose of engaging the respective ends of the plate are clamping and tensioning mechanisms 23, 24. Attention will first be given to the mechanism 23, the mechanism 24 being largely duplicative. Extending longitudinally in the right-hand portion of the gap is a mounting bar 30 having a seating surface 31, an upper surface 32, a righthand surface 33 which faces the side wall 12 of the gap and an inwardly facing surface 34. The mounting bar 30 is preferably of composite construction having a first portion 35 which is of L-shaped cross section and a filler portion 36 which occupies the center of the L.

For the purpose of rigidly joining the portions 35, 36 together into a monolith, they are coupled, on the underside, by a pedestal 40 (see FIG. 4) penetrated by a pair of upwardly extending screws 41, 42. Similar pedestals 40 are provided at intervals along the length of the mounting bar and the sections are, in addition, clamped together by spaced clamping screws 43 which are at right angles to the screws 41, 42.

For the purpose of mounting the bar 30 for limited broadwise movement within the gap, base plates, secured to the bottom surface 14 of the gap, are associated with the pedestals 40. For example as shown in FIG. 4 a base plate 45 is secured to the bottom surface of the gap by means of screws 46, 47. The base plate is provided with an overhanging lip 48 which cooperates with a lip 49 on the pedestal to maintain the mounting bar seated in the gap in the face of large centrifugal forces. For guiding the bar 30 along a path of peripheral movement, the bar includes a guide pin 50 which rides in a groove 51 formed in the base plate.

Figure 3:
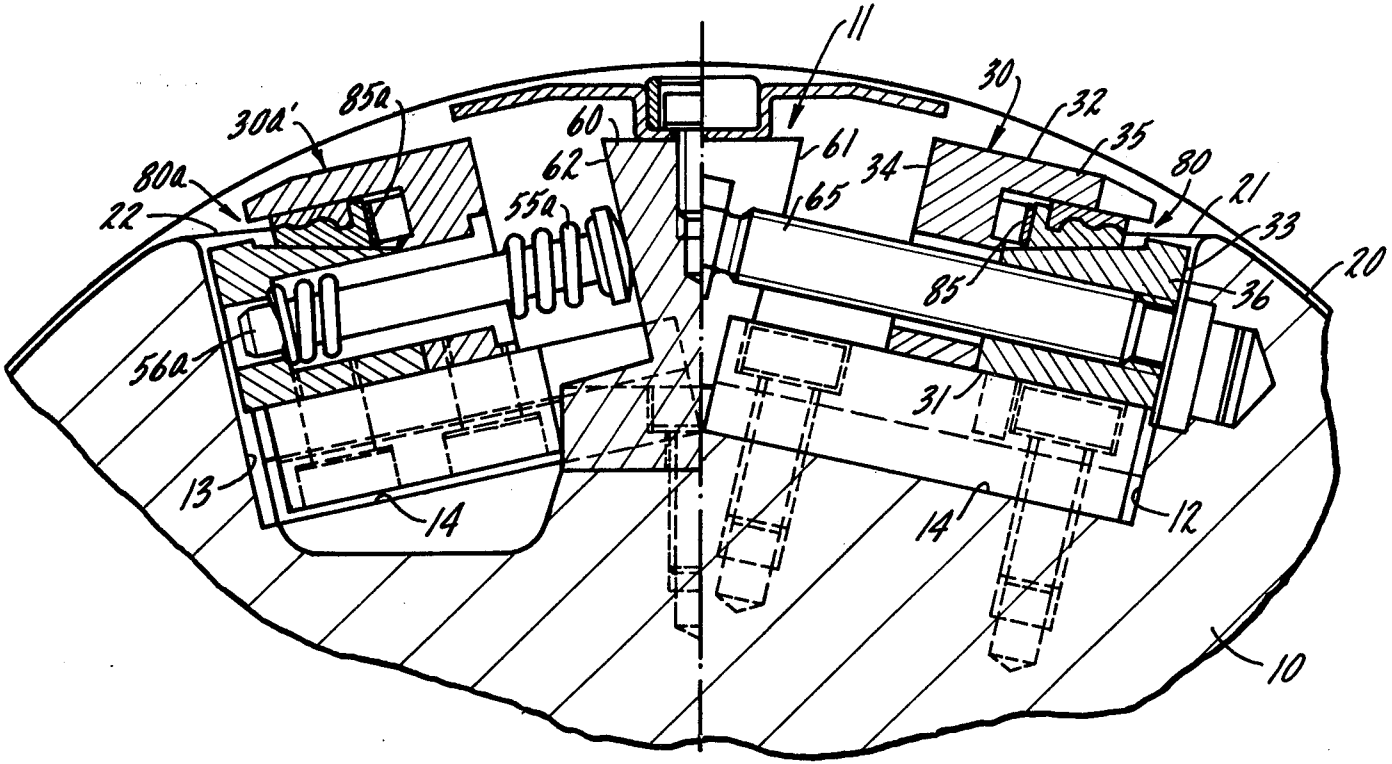
FIG. 3 is a second transverse section taken along the line 3—3 in FIG. 1.

Means including a spring and jack screw are provided for biasing and positioning the mounting bar. In the preferred embodiment a spring, or rather series of springs, biases the mounting bar in the direction of the plate while a series of jack screws bears against the adjacent wall of the gap to move the mounting bar broadwise against the biasing force. Referring to FIGS. 1 and 3, a coil spring 55 is provided surrounding a plunger 56, the spring and plunger being accommodated in a counter bore 57. The head of the plunger, indicated at 58, is supported by a radial bracket 60 mounted at the center of the gap and which presents abutting surfaces 61, 62. In the present embodiment the mounting bar 30 is positively positioned by spaced jack screws, one of which is shown at 65, threaded at 66 and presenting a tip 67 to the side wall 12 of the gap. Preferably the side wall includes inserted thrust pieces 68 of hard non-wearing material. It will be apparent, then, that the springs 55 constantly urge the mounting bar toward the wall 12 of the gap while the jack screws 65 serve to jack the mounting bar broadwise to a desired position of adjustment spaced from the wall.

Figure 2:
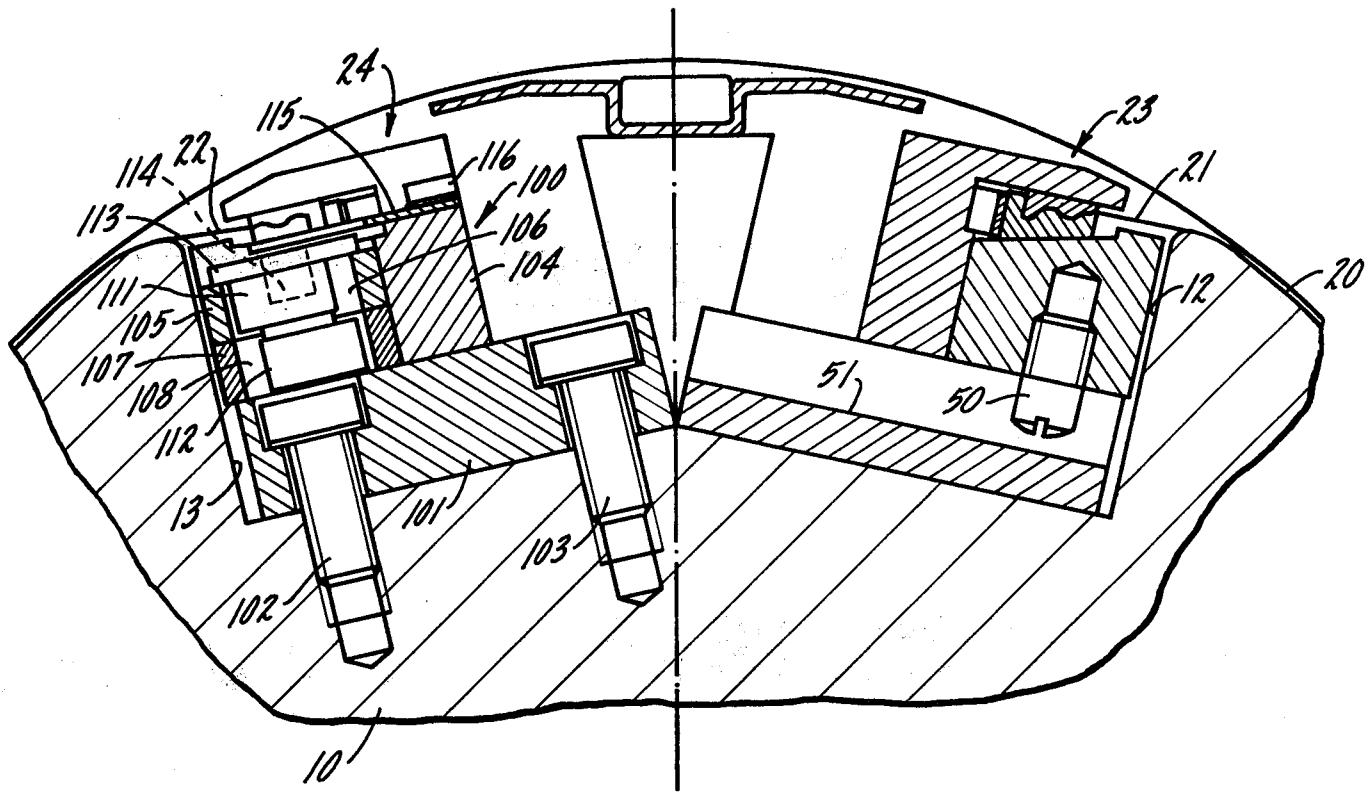
FIG. 2 is a fragmentary transverse section taken along the line 2—2 in FIG. 1.

In accordance with the invention the mounting bar 30 has a longitudinal groove which is oriented in the direction of the plate end (to the right in FIGS. 2 and 3) and which is of dovetail cross section presenting opposed wedging surfaces defining a shallow wedge angle between them. A clamping bar extends longitudinally in the groove, the bar being of wedge cross section and formed of mating upper and lower jaws presenting specially shaped clamping surfaces and with a biasing spring for urging the clamping bar outwardly of the groove. The wedge angle is sufficiently shallow and the purchase of the jaws sufficiently great so that movement of the mounting bar in a direction to tension the inserted plate end acts sequentially to (a) deform the plate end and (b) bodily draw it to a tensioned operating state. Thus the member 30 is formed with a groove 70 which is of dovetail shape, which for the purpose of the present application shall be defined as of wedge cross section (FIG. 5), being wider at the base or root than at the mouth, presenting opposed wedging surfaces 71, 72 defining a relatively shallow wedge angle $\alpha$ between them as well as a root surface 73.

Mounted for broadwise movement within the groove 70 is a clamping bar 80 of wedge cross section formed of an upper jaw 81 (FIG. 6) and a lower jaw 82. For the purpose of registering the jaws together for movement in unison, the upper jaw has a ridge 83 at its base which fits into a longitudinal recess 84 in the base of the lower jaw. For the purpose of pressing the composite clamping bar 80 outwardly of the groove a flat wave spring 85 is interposed between it and the root 73 of the groove. Such spring exerts a tailored force. The force is light enough so that it can be overcome by the manual insertion of the end 21 of the plate so as to enable spreading of the jaws apart for insertion of the plate end between them. Yet the force of the spring is sufficiently great so that once the plate is fully inserted the reaction force of the spring, combined with the wedging effect of the surfaces 71, 72 will cause sufficient force to bear on the respective sides of the plate to produce "purchase", that is, to produce sufficient frictional effect so that when the mounting bar is subsequently withdrawn to tension the plate, the plate will not idly pull free but will, on the contrary, stay within the jaws to be deformed by the jaws as the jaws close together. In a practical case the wedge angle may be on the order of 6 to 15 degrees and the amount of spring reaction force for achieving the desired degree of "purchase" may be readily selected by one skilled in the art.

In accordance with the preferred form of the present invention the cooperating jaw surfaces indicated at 86, 87 are in the form of interfitting, longitudinally extending ridges which mate with one another in such a fashion as to deform the end of the plate into a wavy cross section for positive retention regardless of the degree of tensioning force that may ultimately be applied. However, it will be understood that the particular wavy configuration which has been illustrated, while preferred, may be departed from without departing from the spirit or scope of the invention, provided that there is deformation resulting from the wedging action as tension is progressively applied.

The discussion has, for the sake of simplicity, concentrated upon the right-hand mechanism 23. It will be understood that the structure of the left-hand mechanism 24, which engages the other end of the plate is similar to the extent that similar reference numerals are applicable with the addition of subscript *a*, and the operation is the same. However, in accordance with one of the additional features of the invention, the mounting bar, instead of being in one continuous length, is separated into two sections indicated at 30*a*, 30*a'* presenting ends 91, 92 which are spaced apart. Each of the mounting bar sections 30*a*, 30*a'*, it will be understood, is separately fitted with springs and jack screws so that the sections may be individually adjusted. This makes it possible for the printing cylinder to accommodate either a single plate extending the length of the cylinder or two plates of half width.

In accordance with one of the aspects of the present invention an expandible filler assembly is interposed between the presented ends 91, 92 of the bar sections. The filler assembly, indicated at 100, includes a base plate 101 held in the root of the gap by screws 102, 103 (see FIGS. 2 and 7) and having a guide block 104. The guide block serves to mount a first horizontal slide 105 having a central opening 106 and a second horizontal slide 107 having an opening 108. Registered in the openings are eccentrics 111, 112 which are integral with one another and which have a common head 113 having a central tool socket 114. The latter is maintained in seated position by means of a U-shaped retainer member member 115 which is held in place on the guide block 104 by a pair of screws 116. Upon insertion of a tool such as an Allen type wrench into the socket 114, the two slides 105, 107 are thrust in opposite directions until seated against the presented ends 91, 92 of the mounting bar sections. This prevents any relative endwise movement between the sections. Thus where the two sections engage the common end of a single plate there is no possibility that the plate, in the region between the sections, might become buckled.

It will be apparent that clamping up a plate, using the above construction, is a simple matter. The ends of the plate, 21, 22 are inserted into the jaws of the clamping bars 80, 80*a*. To facilitate insertion the leading edges or lips of the jaws may be rounded or beveled as illustrated in FIG. 6. Each end of the plate is inserted until it is bottomed edgewise accompanied by compression of the respective wave springs 87, 87*a*. This insertion and bottoming may be facilitated by use of the demounting tool to be described. Upon releasing the plate (and tool if used), the wave springs "take over" forcing the clamping bars 80, 80*a* toward the mouths of the grooves, a movement which is accompanied by inward wedging of the jaws against the upper and lower plate surfaces, developing a substantial amount of friction against such surfaces. Thus when the mounting bars 30, 30*a* are advanced broadwise in a tensioning direction, there is sufficient "purchase" in the form of friction at the plate surfaces so that the clamping bars tend to follow the plate, rather than letting go of it. Initially applied tension produces an inward squeezing together of the jaws. Such inward squeezing action is developed with a high mechanical advantage where a shallow wedge angle is used. As a result, the metal of the plate is actually deformed by the jaw surfaces 81, 82, into a wavy contour which positively locks the plate in the jaws. Continued tightening of the jack screws, after the metal has been deformed, builds up tension in the plate to the desired operating level.

While the invention has been described in connection with jack screws which positively position the mounting bar, the functions of spring and jack screw may be reversed in one of the mounting bar positions as illustrated diagrammatically in FIG. 8 in which corresponding elements are indicated by corresponding reference numerals plus addition of subscript *b*. As here shown the mounting bar 30*b*, instead of being pressed by spring force in the direction of the plate, is pressed by spring 55*b* in a direction to tension the plate. The jack screw 65*b*, instead of being in abutment with the wall 12 of the gap, is threaded into the wall thereby to overcome the force of the biasing spring when it is desired to release the plate and performing a throw-off function.

Figure 10:
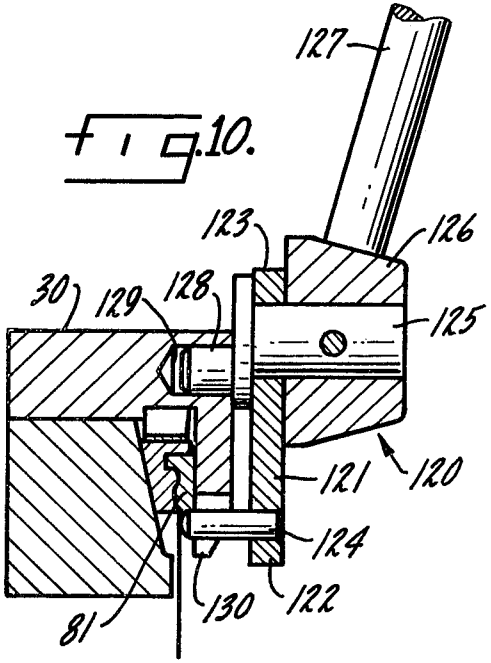
FIG. 10 is a section looking along the line 10—10 in FIG. 9.
Figure 9:
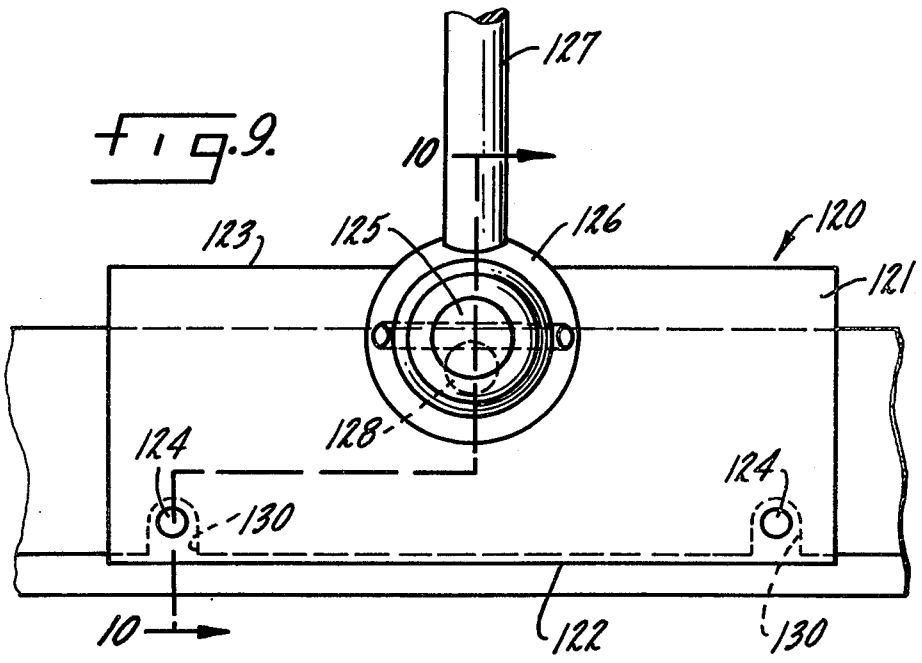
FIG. 9 is a plan view of a demounting tool constructed in accordance with the invention.

In accordance with one of the aspects of the invention a demounting tool is provided, as shown in FIGS. 9 and 10, for the purpose of retracting the clamping bar inwardly of the groove from its wedged condition for disengagement of the bar from the wedging surfaces so as to permit spreading of the jaws and release of the end of the plate. Such demounting tool, indicated at 120, includes a plate 121 having a forward edge 122 and a rear edge 123. Mounted along the forward edge are a pair of pins 124 which project downwardly a sufficient distance to engage the upper jaw 81. In carrying out the invention a manual operator is interposed between the plate 121 and the mounting bar 30 for applying a highly leveraged retracting force to the plate so that the pins 124 press inwardly for unseating of the clamping bar. In the present instance this is accomplished by a manual operator having a shaft 125 which is journaled in the plate and to which is pinned a hub 126 which has an operating lever 127. Eccentrically secured to the shaft 126 is a pivot 128 which is received in a shallow bore 129 formed in the upper surface of the mounting bar. The overhanging portion of the mounting bar is notched out as indicated at 130 to accommodate the pins 124.

It will be apparent that installation and operation are quite simple. The tool is seated upon the mounting bar with the pivot 128 temporarily received, for anchoring purposes, in the bore 129. Swinging of the manual lever 127 moves the plate 121 inwardly of the mounting bar with the spaced pins 124 engaging the front edge of the upper jaw 81. Because of the interengagement between the jaws (ridge 83 engaging groove 84), the jaws move in unison in a direction to release the wedging force and, incidentally, to compress the wave spring. The use of an eccentric has the advantage that the lever 127 may be swung "on center" to maintain the clamping bar jaws retracted. This retraction serves to separate the jaws from one another so that the engaged end of the plate may be withdrawn from between the jaws, following which the tool may be released. It will be understood that a plurality of shallow bores 129 may be provided at spaced intervals along the mounting bar to retract the clamping bar from its wedged condition. Since it is the deformation of the plate metal and not high clamping forces which are relied upon to hold the end of the plate captive, the wedge angle may be made less shallow than might otherwise be required so that relatively light forces suffice to separate the parts from their wedged condition. Because of the mechanical advantage which is inherent in the use of an eccentric, finger tip pressure suffices to swing the lever 127 into its plate-releasing position.

It is to be particularly noted that the plate is positively held captive without any necessity for disengagement of roughened wedge surfaces such as have been necessary in certain prior art constructions. By contrast, in the present construction, all of the surfaces are smoothly finished so as to produce predictable forces free from the effects of localized wear. As a result the present clamping and tensioning mechanism may be employed for long periods of time with constant operating characteristics. It will, moreover, be apparent to one skilled in the art that the structure is inherently economical involving ordinary tolerances and parts which are easily machined and assembled.

While the invention has been described in connection with a printing plate, it will be apparent that the features and advantages of the invention may be utilized wherever it is desired to mount a thin metal plate upon a cylinder and the term "printing plate" therefore is to be broadly construed. The term "jack screw", it will be understood, is not intended to be limited to the particular form of screw which has been illustrated but includes any screw capable of moving the mounting bar. The term "deform" includes localized upsetting as well as bodily deformation.

What I claim is:

1. In a clamping and tensioning mechanism for mounting a thin flexible printing plate on the surface of a printing cylinder having a longitudinal gap formed therein, the combination comprising a mounting bar extending longitudinally in the gap and having means for guiding the same for broadwise movement peripherally of the cylinder, said mounting bar having a longitudinal groove formed therein oriented in the direction of the end of the plate, the groove being of dovetail cross section presenting spaced opposed smooth wedging surfaces defining a wedge angle between them, a two piece clamping bar extending longitudinally in the groove, the two piece clamping bar being of overall matching wedge cross section with said groove and formed of mating upper and lower jaws having smooth outer surfaces angled to engage the wedging surfaces and separable one from the other to permit the end of a plate to be shoved between them when contained in the broader region of the groove and presenting opposed gripping surfaces specially shaped to frictionally engage and deform the end of the plate for gripping the end of the plate when they are pressed together, a clamping bar spring for biasing the clamping bar outwardly of the groove, means for forcibly moving the mounting bar broadwise in the gap in the plate tensioning direction, the wedge angle being sufficiently shallow so that when the end of the plate is inserted between the jaws and the mounting bar is moved in the plate tensioning direction, relative sliding takes place at the smooth surfaces and the jaws of the clamping bar are wedgingly pressed together to retain and deform the end of the plate to provide a positive grip and upon continued movement of the mounting bar the end of the plate is bodily drawn to tension the plate about the cylinder, and means mounted on said mounting bar engageable with the upper jaw for subsequently retracting the clamping bar inwardly of the groove for disengagement of the wedging surfaces to permit spreading of the jaws and release of the end of the plate, the jaws having abutting surfaces thereon to keep the jaws in register with one another in all positions thereof.

2. The combination as claimed in claim 1 in which the biasing spring for the clamping bar is in the form of a wave spring mounted in the root of the longitudinal groove.

3. The combination as claimed in claim 1 in which one of the jaws of the clamping bar has a longitudinal ridge extending along its base portion and the other jaw has a mating longitudinal recess to keep the jaws in register with one another while permitting mutual separating movement.

4. The combination as claimed in claim 1 in which the means for retracting the clamping bar inwardly of the groove for disengagement of the wedging surfaces is in the form of a plate superimposed upon the mounting bar, the leading edge of the plate being formed to enter the groove and to retractingly engage the upper jaw, and manual operating means interposed between the plate and the mounting bar for causing edgewise movement of the plate in a direction inwardly of the groove for applying to the upper jaw an unseating force in a direction to unseat the clamping bar from the wedging surfaces, the engagement of the operating means with the mounting bar being such as to enable ready disengagement and removal during normal operation of the printing cylinder.

5. The combination as claimed in claim 1 in which the means for retracting the clamping bar inwardly of the groove for disengagement of the wedging surfaces is in the form of a tool including a plate overlying the mounting bar and having downwardly projecting jaw-engaging means along its forward edge for entering the groove and retractingly engaging the upper jaw, the plate having a manually operated eccentric, the eccentric including a pivot extending into a registering opening formed in the mounting bar so that when the eccentric is manually rotated the front edge of the plate is powerfully retracted thereby to retract the clamping bar, the engagement of the pivot with the mounting bar serving to temporarily anchor the plate with respect to the mounting bar but with the pivot being of limited length and freely disengageable from the opening for removal of the plate during normal operation of the press.

6. In a clamping and tensioning mechanism for mounting a thin flexible printing plate on the surface of a printing cylinder having formed therein a longitudinal gap defined by opposed side walls and a bottom wall, the combination comprising a mounting bar extending longitudinally in the gap, means secured to the bottom wall of the gap for guiding the mounting bar for broadwise movement peripherally of the cylinder, said mounting bar having a longitudinal groove formed therein oriented in the direction of the end of the plate, the groove being of dovetail cross section presenting spaced opposed smooth wedging surfaces defining a wedge angle between them, a two piece clamping bar extending longitudinally in the groove, the two piece clamping bar being of overall matching wedge cross section with said groove and formed of mating upper and lower jaws having smooth outer surfaces angled to engage the wedging surfaces and separable one from the other to permit the end of a plate to be shoved between them when contained in the broader region of the groove and presenting opposed plate-gripping surfaces specially shaped to frictionally engage and deform the end of the plate for gripping the end of the plate when they are pressed together, a clamping bar spring for biasing the clamping bar outwardly of the groove, a plurality of mounting bar springs for biasing the clamping bar in the direction of the edge of the plate, a plurality of jack screws threaded into the mounting bar and bearing against the adjacent side wall of the gap for forcibly moving the mounting bar broadwise in the gap in the plate tensioning direction, the wedge angle being sufficiently shallow and the gripping surfaces providing sufficient initial purchase so that when the end of the plate is inserted between the jaws and the jack screws are tightened to move the mounting bar in the plate tensioning direction relative sliding takes place at the smooth surfaces and the jaws of the clamping bar are wedgingly pressed together to retain and deform the end of the plate to provide a positive grip thereon and so that upon continued tightening of the jack screws the end of the plate is bodily drawn to tension the plate about the cylinder, the jaws of the clamping bar having longitudinally extending base portions interfittingly keyed together so that when the upper jaw is retracted inwardly of the groove the lower jaw is retracted in unison therewith for disengagement of the wedging surfaces to permit spreading of the jaws and release of the end of the plate.

* * * * *